US006051108A

United States Patent [19]

O'Neal, Jr.

[11] Patent Number: 6,051,108

[45] Date of Patent: Apr. 18, 2000

[54] METHOD OF REMOVING AND PREVENTING THE BUILDUP OF CONTAMINANTS IN PAPERMAKING PROCESSES

[75] Inventor: Ollie O'Neal, Jr., Aurora, Ill.

[73] Assignee: Nalco Chemical Company, Naperville, Ill.

[21] Appl. No.: 09/123,530

[22] Filed: Jul. 28, 1998

[51] Int. Cl.[7] ..... D21F 1/32

[52] U.S. Cl. ..... 162/199; 162/275; 162/DIG. 4; 134/3; 134/40; 134/41

[58] Field of Search ..... 162/199, 275, 162/DIG. 4; 134/3, 40, 41

[56] References Cited

U.S. PATENT DOCUMENTS

| | | | |
|---|---|---|---|
| 4,995,944 | 2/1991 | Aston et al. | 162/199 |
| 5,368,694 | 11/1994 | Rohlf et al. | 162/199 |
| 5,368,749 | 11/1994 | La Zonby | 210/756 |
| 5,575,893 | 11/1996 | Khan et al. | 162/199 |
| 5,776,310 | 7/1998 | McDermott et al. | 162/199 |
| 5,863,385 | 1/1999 | Siebott et al. | 162/199 |
| 5,914,006 | 1/1999 | Nellessen et al. | 162/158 |

FOREIGN PATENT DOCUMENTS

| | | |
|---|---|---|
| 58-13795 | 1/1983 | Japan . |
| 58-91886 | 5/1983 | Japan . |
| 62-21893 | 1/1987 | Japan . |
| 3-33289 | 2/1991 | Japan . |
| 4-202299 | 7/1992 | Japan . |
| 8-39529 | 2/1996 | Japan . |
| WO 93/23517 | 11/1993 | WIPO . |
| WO 96/19558 | 6/1996 | WIPO . |
| 97/07886 | 3/1997 | WIPO . |

*Primary Examiner*—Sean Vincent
*Attorney, Agent, or Firm*—Kelly L. Cummings; Thomas M. Breininger

[57] ABSTRACT

A method is disclosed for removing and preventing the buildup of contaminants in papermaking wet press felts and on forming wires using a cleaning solution which contains at least one acidic cleaning compound and peracetic acid.

23 Claims, No Drawings

METHOD OF REMOVING AND PREVENTING THE BUILDUP OF CONTAMINANTS IN PAPERMAKING PROCESSES

FIELD OF THE INVENTION

The invention relates generally to cleaning solutions for papermaking processes and, more particularly, to a method of removing and preventing the buildup of contaminants in papermaking wet press felts and on forming wires.

BACKGROUND OF THE INVENTION

Paper is made by depositing cellulose fibers from a very low consistency aqueous suspension onto a relatively fine woven synthetic screen known as a forming wire or a forming fabric. A forming wire is a cloth woven from monofilaments, made endless by a seam to form a continuous belt. Both single and multi-layer wires are used in papermaking processes. The mesh of the wire permits the drainage of water while retaining the fibers. Over 95% of the water is removed by drainage through the forming wire.

Sheet formation on the forming wire is a complicated process that is achieved by three basic hydrodynamic processes: drainage, oriented shear and turbulence. The hydrodynamic effects must be applied in different degrees to optimize sheet quality for each grade of paper run on a paper machine.

There are many additives and processing aids that are used in a pulp and paper mill system. The addition starts with the incoming water and the wood chips going to the digester. Contaminants can also enter the system at this time. In fact, any additive to a pulp and paper system can introduce components that can end up as contaminants in a paper machine stock system. Contaminants and additives can build on the surface or become trapped between the multi-layer construction of the forming wire. High pressure water showers and low pressure chemical cleaning showers are used to remove deposits after the wet sheet leaves the wire. Any deposit on the wire can disrupt the sheet formation process by interfering with one or more of the three basic hydrodynamic processes.

After the formation of the wet paper web in the forming section of the paper machine, it is transferred to the press section by way of a pick-up roll. The primary purpose of the press section is to remove the maximum amount of water from the sheet before it enters the dryer section. The wet sheet will enter the press section at about 80% moisture and exit at approximately 55%. Maximizing moisture removal in the presses reduces the cost of operating the drying section. The press section can also improve properties such as sheet bulkiness and smoothness.

The press section removes water by running the sheet through a series of nip presses. A typical paper machine with a center roll will have three presses, each having two rolls and two wet press felts. As the wet web passes through a press, water removal is accomplished by squeezing the sheet through the nip of the two rolls. The two wet press felts (top and bottom) convey and support the wet sheet as it passes through the press and receives water expressed from the wet sheet in the nip.

Felt filling or plugging is caused by soils and additives becoming imbedded in the felt body thereby reducing the void volume and permeability, and in turn reducing the felt's ability to receive the water expressed from the web in the press nip. Almost all types of paper being recycled as broke contain a wide variety of potential system contaminants. For example, inorganic contaminants such as manganese, iron, copper and aluminum can deposit in wet press felts and on forming wires, thereby reducing drainage and causing runnability problems for the mill. High concentrations of mineral acids such as sulfuric acid-based cleaning compounds are usually required to remove the deposits. However, at times, the deposits can be so severe that they cannot be effectively removed with a full strength mineral acid compound. Moreover, high concentrations of mineral acids can severely damage press felts and forming wires.

Different processes and equipment are used to handle the complex challenge of separating useful fibers from inorganic and polymeric contaminants. However, regardless of how well this separation is accomplished, many microscopic and larger particles escape into accept streams and end up in the paper machine system. These particles lead to contamination of the paper machine felts. One such particle type is polyamide wet-strength resin associated with the manufacture of toweling grade tissues and other wet strength grades.

Over a period of time, resins can build in the void areas of the wet press fell and lead to reductions in permeability, as well as the ability of the felt to remove water. Currently, some mills will batch clean the felts with sodium hypochlorite. The major disadvantage of using sodium hypochlorite, however, is the degrading effect it can have on the nylon batt fibers. When the concentration of sodium hypochlorite exceeds 1 ppm for extended periods of time, it can cause premature felt damage. Moreover, production typically needs to be stopped to batch clean the felts with sodium hypochlorite, thereby leading to costly downtime.

In addition to the more traditional soils, spores and spore-forming bacteria can also accumulate in the felts. This can lead to a re-deposition of spores in the food grade board that increases the final spore count. If the spore count becomes too high, the board must be downgraded and sold in a non-food grade market. Sheath material associated with filamentous bacteria can also accumulate in the void area of the felt, thus resulting in a reduction in its ability to remove water. The problems associated with the buildup of sheath material can be experienced in any type of paper mill.

Accordingly, it would be desirable to provide an improved method of removing and preventing the buildup of contaminants in papermaking wet press felts and on forming wires without severely damaging the felts and wires. In particular, it would be highly desirable to utilize a cleaning solution to remove and prevent the buildup of manganese contaminants in wet press felts and on forming wires, as well as to remove and prevent the buildup of wet-strength resins, spores and sheath material from wet press felts during a normal continuous cleaning operation.

SUMMARY OF THE INVENTION

The method of the invention calls for treating papermaking wet press felts and forming wires with a cleaning solution which contains at least one acidic cleaning compound and peracetic acid. This treatment method effectively removes and prevents the buildup of contaminants, particularly manganese contaminants, in wet press felts and on forming wires, without severely damaging the felts and wires. The treatment method also effectively removes and prevents the buildup of wet-strength resins, spores and sheath material from wet press felts during a normal continuous cleaning operation.

DETAILED DESCRIPTION OF THE INVENTION

The present invention is directed to a method of removing and preventing the buildup of contaminants in papermaking wet press felts and on forming wires. In accordance with the invention, the press felts and forming wires are treated with a cleaning solution which contains one or more acidic cleaning compounds and peracetic acid (PAA). The acidic cleaning compound may either be an organic acid or a mineral acid.

Any organic acid may be used in the practice of this invention, however, hydroxyacetic acid, acetic acid, citric acid, formic acid, oxalic acid and sulfamic acid are preferred. Hydroxyacetic acid and citric acid are the most preferred organic acids.

The mineral acids which may be used in the practice of the present invention include sulfuric acid, phosphoric acid, nitric acid and hydrochloric acid. However, because nitric and hydrochloric acid are highly corrosive, sulfuric and phosphoric acid are preferred.

The acidic cleaning compound and PAA are used at a concentration which will effectively remove and prevent the buildup of contaminants in a papermaking wet press felt and on a forming wire. It is preferred that the amount of PAA in the cleaning solution be in the range of about 0.0001 to about 1% by weight. More preferably, the amount of PAA in the cleaning solution is from about 0.001 to about 0.05%, with about 0.003 to 0.02% being most preferred.

When an organic acid is used in the cleaning solution with the PAA, the amount of organic acid ranges from about 0.2 to about 30% by weight, and preferably from about 1 to about 10% by weight.

When a mineral acid is utilized in the cleaning solution in accordance with this invention, the amount of mineral acid ranges from about 0.001 to about 20% by weight, and preferably from about 0.01 to about 10% by weight.

The cleaning solution may further include one or more surfactants. The surfactants may be anionic, cationic, nonionic or amphoteric. Any surfactant commonly utilized in cleaning solutions for wet press felts and forming wires may be used. Suitable surfactants include amine oxides, ethoxylated alcohols and dodecylbenzene sulfonic acid.

It is preferred that the amount of surfactant in the cleaning solution be in the range of about 0.001 to about 10% by weight and, more preferably, in the range of about 0.01 to about 1% by weight.

The cleaning solution may additionally include one or more glycol ethers to further enhance the cleaning of the wet press felts and forming wires. The glycol ethers which may be used include diethylene glycol ether, ethylene glycol monobutyl ether, propylene glycol monobutyl ether, diethylene glycol monoethyl ether, ethylene glycol monoethyl ether, diethylene glycol monohexyl ether, propoxy propanol, ethylene glycol monohexyl ether, diethylene glycol monomethyl ether, propylene glycol methyl ether, dipropylene glycol methyl ether and tripropylene glycol methyl ether.

It is preferred that the amount of glycol ether in the cleaning solution be in the range of about 0.1 to about 30% by weight.

Water makes up the remaining weight percent of the cleaning solutions.

The present inventor has discovered that cleaning solutions containing one or more acidic cleaning compounds and PAA effectively remove and prevent the buildup of contaminants, particularly manganese contaminants, in wet press felts and on forming wires. In addition, the cleaning solutions can be used to remove and prevent the buildup of wet-strength resins from felts. Removal of wet-strength resins during the normal continuous cleaning operation will eliminate the need to stop production and batch clean the felts with sodium hypochlorite. This will save downtime and extend the life of felts. The inventor has also found that the cleaning solutions of the invention can be used to facilitate the removal of spores and sheath material from felts during a normal continuous felt cleaning operation. A major advantage of using PAA is that it is more stable under acidic conditions than other strong oxidizing agents, and it is Considerably less damaging to wires and felts.

EXAMPLES

The following examples are intended to be illustrative of the present invention and to teach one of ordinary skill how to make and use the invention. These examples are not intended to limit the invention or its protection in any way.

Example 1

Experiments were carried out in the laboratory to evaluate the use of peracetic acid (PAA) in conjunction with organic acids to facilitate the removal of manganese deposits from forming wires. A forming wire from Mill 'A' containing a uniform manganese deposit was used for the tests. Manganese type deposits are characterized by a distinctive dark brown to black color. Test specimens having an average G.E. Brightness of 3.8 were cut from the forming wire and were used in the cleaning experiments. The cleaning solution was prepared just prior to running the test. The temperature of the cleaning solution was maintained at 130° F. while mixing for the 30 minute duration of the test. Aqueous cleaning solutions containing 3.5% organic acid were evaluated at varying levels of PAA. The test results were quantified using G.E. Brightness measurements.

The Technidyne Model S4-M G.E. Brightness Tester was used to evaluate the effectiveness of removing manganese deposits from the forming wire test specimens. This device employs a single beam lamp that is operated at 7.0 volts D.C. The brightness of the unclean and cleaned test specimens were compared to a working standard consisting of a white opal glass block of known brightness. The results are shown in Table 1.

TABLE 1

| SOLUTION # | ORGANIC ACID | CONC. (%) | PERACETIC ACID CONC. (%) | G.E. BRIGHTNESS |
|---|---|---|---|---|
| | Control | — | — | 3.8 |
| 1 | Hydroxyacetic Acid | 3.5 | 0 | 7.7 |
| 2 | Hydroxyacetic Acid | 3.5 | 0.00075 | 9.2 |
| 3 | Hydroxyacetic Acid | 3.5 | 0.00150 | 13.1 |
| 4 | Hydroxyacetic Acid | 3.5 | 0.00300 | 15.0 |
| 5 | Rydroxyacetic Acid | 3.5 | 0.00600 | 31.5 |
| 6 | Hydroxyacetic Acid | 3.5 | 0.00900 | 47.2 |
| 7 | Citric Acid | 3.5 | 0 | 18.6 |
| 8 | Citric Acid | 3.5 | 0.00075 | 31.6 |
| 9 | Citric Acid | 3.5 | 0.00150 | 46.5 |
| 10 | Citric Acid | 3.5 | 0.00300 | 47.1 |
| 11 | Citric Acid | 3.5 | 0.00600 | 47.9 |
| 12 | Citric Acid | 3.5 | 0.00900 | 48.0 |

The test specimen after cleaning with Solution #1 containing hydroxyacetic acid without PAA had a G.E. Brightness of 7.7. With the addition of 0.0006% PAA (Solution # 5), the G.E. Brightness after the cleaning test was increased to 31.5. When the organic acid was citric, the G.E. Brightness was increased from 18.6 (Solution #7) to 47.9 (Solution #11). The test results show that PAA clearly enhances the cleaning properties of both hydroxyacetic and citric acids.

Example 2

The cleaning solutions in Example 1 were aqueous solutions containing an organic acid and PAA. In this example, laboratory cleaning tests were run to evaluate the effect of the addition of a surfactant to cleaning solutions containing citric acid and PAA. The results are shown in Table 2.

TABLE 2

| SOLUTION # | CITRIC ACID CONC. (%) | (%) AMINE OXIDE | PERACETIC ACID CONC. (%) | G.E. BRIGHTNESS |
|---|---|---|---|---|
| | — | — | — | 3.8 |
| 13 | 0.5 | 0 | 0 | 14.4 |
| 14 | 0.5 | 0.5 | 0 | 31.4 |
| 15 | 0.5 | 0.5 | 0.00075 | 34.3 |
| 16 | 0.5 | 0.5 | 0.00150 | 40.1 |
| 17 | 1 | 0 | 0 | 24.6 |
| 18 | 1 | 1 | 0.00150 | 39.3 |
| 19 | 1 | 1 | 0.00300 | 40.7 |
| 20 | 0 | 0.5 | 0 | 5 |
| 21 | 0 | 0.5 | 0.00150 | 11 |
| 22 | 0 | 0.5 | 0.00300 | 11.3 |
| 23 | 0 | 0.5 | 0.00600 | 10.9 |
| 24 | 0 | 0.5 | 0.00900 | 11.3 |

The purpose of the surfactant is to increase the wetting and soil penetration properties of the cleaning solution. The test procedure and forming wire from Mill 'A' in Example 1 were used for this evaluation. As illustrated in Table 2, the cleaning results were even more dramatic. When 0.5% of an alkyl dimethyl amine oxide was added to an aqueous solution containing 0.5% citric acid, the G.E. Brightness increased from 14.4 (Solution #13) to 31.4 (Solution # 14). The addition of 0.0015% PAA (Solution #16) further increased the G.E. Brightness to a value greater than 40.

Increasing the concentrations of organic acid and surfactant also resulted in an increased G.E. Brightness (Solutions #17 through 19). In the absence of an acid source, the increases in G.E. Brightness were less dramatic (Solutions #20 through 24). Regardless of the concentrations of the organic acid and surfactant, cleaning was further enhanced by the addition of PAA.

Example 3

Additional cleaning tests were carried out using the forming wire from Mill 'A' to see if the addition of a solvent would further improve the removal of manganese deposits. A glycol ether (dipropylene glycol methyl ether) was evaluated in aqueous cleaning solutions containing 0.5% each of citric acid and amine oxide at varying levels of PAA. Table 3 shows the results of this work. The solvent had little to no affect on the removal of this deposit. If the deposit had contained a higher level of organic soils, the addition of a solvent would have shown an improvement.

TABLE 3

| SOLUTION # | CITRIC ACID (%) | AMINE OXIDE (%) | GLYCOL ETHER (%) | PERACETIC ACID (%) | G.E. BRIGHT-NESS |
|---|---|---|---|---|---|
| 25 | 0.5 | 0.5 | 0 | 0 | 31.4 |
| 26 | 0.5 | 0.5 | 0 | 0.00075 | 34.3 |
| 27 | 0.5 | 0.5 | 0 | 0.00150 | 40.1 |
| 28 | 0.5 | 0.5 | 5 | 0 | 33.9 |
| 29 | 0.5 | 0.5 | 5 | 0.00075 | 21.7 |
| 30 | 0.5 | 0.5 | 5 | 0.00150 | 39.9 |

Example 4

The composition and severity of manganese type deposits can vary from mill to mill and day to day on a given paper machine. The variability of the deposits is due primarily to the concentration and type of contaminants in the machine system. Laboratory cleaning data was generated in another set of experiments using a forming wire from Mill 'B', with an average G.E. Brightness of 4.9. The test results in Table 4 show the relationship between hydroxyacetic acid concentration and manganese soil removal expressed as an improvement in G.E. Brightness.

TABLE 4

| SOLUTION # | HYDROXYACETIC ACID (%) | G.E. BRIGHTNESS |
|---|---|---|
| 31 | 0 | 4.9 |
| 32 | 1 | 5.2 |
| 33 | 2 | 5.3 |
| 34 | 5 | 7.7 |
| 35 | 10 | 18.5 |
| 36 | 20 | 21.4 |

Without the addition of a surfactant or PAA to the cleaning solutions, significant increases in G.E. Brightness were not seen until the hydroxyacetic acid concentration reached 10% (Solution #35). The most common cleaners contain at a maximum 10 to 20% organic acid. Therefore, this is equivalent to using a full strength product to clean the wire.

A study was then conducted to look at various organic acids (citric, hydroxyacetic, and sulfamic) in combination with a surfactant (9 mole ethoxylated secondary alcohol or amine oxide) and various concentrations of PAA. The test results for this work are shown in Tables 5 through 7.

TABLE 5

| SOLUTION # | ORGANIC ACID | CONC. (%) | SURFACTANT (0.5%) | PERACETIC ACID (%) | G.E. BRIGHTNESS |
|---|---|---|---|---|---|
| | Control | — | — | — | 4.9 |
| 37 | Citric Acid | 2 | Alcohol Ethoxylate | 0 | 8.3 |
| 38 | Citric Acid | 2 | Alcohol Ethoxylate | 0.00075 | 9.5 |
| 39 | Citric Acid | 2 | Alcohol Ethoxylate | 0.00150 | 15.0 |
| 40 | Citric Acid | 2 | Alcohol Ethoxylate | 0.00300 | 20.9 |
| 41 | Citric Acid | 2 | Alcohol Ethoxylate | 0.00600 | 16.7 |
| 42 | Citric Acid | 2 | Alcohol Ethoxylate | 0.00900 | 18.3 |
| 43 | Hydroxyacetic | 0.5 | Alcohol Ethoxylate | 0 | 7.3 |
| 44 | Hydroxyacetic | 0.5 | Alcohol Ethoxylate | 0.00075 | 10.9 |
| 45 | Hydroxyacetic | 0.5 | Alcohol Ethoxylate | 0.00150 | 16 |
| 46 | Hydroxyacetic | 0.5 | Alcohol Ethoxylate | 0.00300 | 18.4 |
| 47 | Hydroxyacetic | 0.5 | Alcohol Ethoxylate | 0.00600 | 19.8 |
| 48 | Hydroxyacetic | 0.5 | Alcohol Ethoxylate | 0.00900 | 18.5 |

TABLE 6

| SOLUTION # | SULFAMIC ACID (%) | SURFACTANT (0.5%) | PERACETIC ACID (%) | G.E. BRIGHTNESS |
|---|---|---|---|---|
| 49 | 0.5 | — | 0 | 8.7 |
| 50 | 0.5 | Alcohol Ethoxylate | 0 | 8.6 |
| 51 | 0.5 | Alcohol Ethoxylate | 0.00450 | 15.7 |
| 52 | 0.5 | Alcobol Ethoxylate | 0.00600 | 20.1 |
| 53 | 0.5 | Amine Oxide | 0.00150 | 13.8 |
| 54 | 0.5 | Amine Oxide | 0.00600 | 23.4 |
| 55 | 5 | Alcohol Ethoxylate | 0 | 8.6 |
| 56 | 5 | Alcohol Ethoxylate | 0.00075 | 8.5 |
| 57 | 5 | Alcohol Ethoxylate | 0.00150 | 9.7 |
| 58 | 5 | Alcohol Ethoxylate | 0.00300 | 12 |

TABLE 7

| SOLUTION # | ORGANIC ACID | CONC. (%) | SURFACTANT (0.5%) | PERACETIC ACID (%) | G.E. BRIGHTNESS |
|---|---|---|---|---|---|
| 59 | Control | 2 | Alcohol Ethoxylate | 0 | 8.1 |
| 60 | Citric Acid | 2 | Alcohol Ethoxylate | 0.00150 | 16 |
| 61 | Citric Acid | 2 | Alcohol Ethoxylate | 0.00600 | 18.8 |
| 62 | Citric Acid | 2 | Amine Oxide | 0 | 8.1 |
| 63 | Citric Acid | 2 | Amine Oxide | 0.00150 | 13.3 |
| 64 | Citric Acid | 2 | Amine Oxide | 0.00600 | 25.2 |
| 65 | Hydroxyacetic | 0.5 | Alcohol Ethoxylate | 0 | 8.1 |
| 66 | Hydroxyacetic | 0.5 | Alcohol Ethoxylate | 0.00150 | 15 |
| 67 | Hydroxyacetic | 0.5 | Alcohol Ethoxylate | 0.00600 | 16.7 |
| 68 | Hydroxyacetic | 0.5 | Amine Oxide | 0 | 8.1 |
| 69 | Hydroxyacetic | 0.5 | Amine Oxide | 0.00150 | 8.1 |
| 70 | Hydroxyacetic | 0.5 | Amine Oxide | 0.00600 | 12.6 |

The data in Table 5 were generated using 0.5% of the ethoxylated secondary alcohol (AE) and citric and hydroxyacetic acids at 2% and 0.5%, respectively. A G.E. Brightness of 20 was obtained with Solution # 47 containing only 0.5% each of hydroxyacetic acid and AE, and 0.006% PAA. A similar solution without PAA (Solution #43) yielded a brightness of only 7.3.

Similar results are shown in Table 6, wherein the two surfactants (amine oxide and AE) were evaluated in aqueous sulfamic acid solutions. The data also appear to show that there is an optimum surfactant level at which improvements in the cleaning efficiency of an organic acid can be seen (Solutions # 49 through 52). Above this concentration there is very little additional brightness until the addition of peracetic acid.

The results are also similar in Table 7, which show comparisons of aqueous solutions of citric and hydroxyacetic acids at concentrations of 2% and 0.5%, respectively. These solutions contained 0.5% amine oxide or AE surfactants with varying concentrations of peracetic acid. PAA improved cleaning regardless of the organic acid type, concentration of the organic acid, surfactant type or concentration of the surfactant up to an optimum concentration.

Example 5

In this example, the practicality of using PAA in aqueous cleaning solutions containing sulfuric or hydroxyacetic acids to remove spore forming bacteria from wet press felts was evaluated. The potential damaging effects were also determined because the use of a mineral acid or a high oxidant environment can be damaging to press felts. When the two are present in combination, the damage to felts can be even more severe. The Nalco Dynamic Felt Cleaning Recirculator was used to evaluate the ability of the cleaning solutions to remove spores from felt test specimens taken from a paper machine in Mill 'C' producing food grade board. The recirculator continuously measures and graphs the changes in differential pressure between the two sides of a felt test specimen. A decrease in differential pressure shows that the test specimen is becoming more permeable, which means an increase in void volume and water permeability. Spore and vegetative bacteria count measurements before and after cleaning were used to determine product efficiency. A vegetative bacteria is a bacteria that is actively growing and reproducing. In contrast, a spore is a bacteria that is not growing and reproducing, but rather is encased in a protective surrounding that keeps it alive. The encasement makes the spore more resistant to changes in the environment, such as temperature and pH.

Table 8 lists the aqueous cleaning solutions used in this example. To evaluate possible felt damage, the duration of each recirculator test was 6 hours. Running the test for 6 hours better simulates the effects of a continuous cleaning operation.

TABLE 8

| SOLUTION # | ACID | % | ALCOHOL ETHOXYLATE (%) | GLYCOL ETHER (%) | PERACETIC ACID (%) |
|---|---|---|---|---|---|
| 71 | Sulfuric | 0.03 | 0.05 | 0.05 | 0.0009 |
| 72 | Hydroxyacetic | 0.1 | 0.05 | 0.05 | 0.0009 |

Table 9 shows the results of this test. Spore counts were reduced by more than 96% with Solutions # 71 and 72. A microscopic evaluation also showed that the conditions of the cleaning tests did not result in chemical damage to the felt.

TABLE 9

| SOLUTION # | VEGETATIVE BACTERIA | % CHANGE | SPORES | % CHANGE |
|---|---|---|---|---|
| Before Cleaning | 20,000,000 | — | 1600 | — |
| 71 | 7,300 | >99.9 | 55 | 96.7 |
| 72 | 3,400 | >99.9 | 25 | 98.4 |

Example 6

The set of experiments in this example was designed to look at the mechanism of spore removal from felts. This data was generated using 30 minute cleaning cycles rather than the 6 hour contact times in Example 5. The shorter cleaning cycle did not allow enough time for PAA to effect kill. Therefore, any reduction was due to a cleaning mechanism rather than a microbiocidial mechanism. This work used a press felt taken from a machine at Mill 'D' which manufactures bleached board (food grade board) used for milk cartons. The Dairyman standard for milk cartons is 250 colony forming units (cfu) per gram of board.

This experiment looked at solutions of citric and hydroxyacetic acids in combination with an amine oxide surfactant and varying amounts of PAA. Table 10 gives a list of the cleaning solutions used in the test, with the results shown in Table 11.

TABLE 10

| SOLUTION # | CITRIC ACID (%) | HYDROXYACETIC ACID (%) | AMINE OXIDE (%) | PERACETIC ACID (%) |
|---|---|---|---|---|
| 73 | 0.4 | — | — | 0 |
| 74 | 0.4 | — | 0.1 | 0 |
| 75 | 0.4 | — | 0.1 | 0.0015 |
| 76 | 0.4 | — | 0.1 | 0.006 |
| 77 | — | 0.4 | 0.1 | 0 |
| 78 | — | 0.4 | 0.1 | 0.0015 |
| 79 | — | 0.4 | 0.1 | 0.006 |

TABLE 11

| SOLUTION # | VEGETATIVE | % CHANGE | SPORE | % CHANGE |
|---|---|---|---|---|
| Control | 5,900,000 | — | 990 | — |
| 73 | 54,000 | 99.1 | 250 | 4.0 |
| 74 | 8,800 | >99.9 | 230 | 48.5 |

TABLE 11-continued

| SOLUTION # | VEGETATIVE | % CHANGE | SPORE | % CHANGE |
|---|---|---|---|---|
| 75 | 3,500 | >99.9 | 10 | 96.0 |
| 76 | 590 | >99.9 | 10 | >99.0 |
| 77 | 4,600 | 99.9 | 250 | 74.7 |
| 78 | 3,800 | >99.9 | 230 | 76.8 |
| 79 | 800 | >99.9 | 10 | 99.0 |

The addition of PAA at the concentration of 0.0015% (Solution #75) to a citric acid and surfactant solution reduced the spore count by 96% versus 49% for a comparable formula without PAA (Solution #74). When the organic acid was hydroxyacetic (Solutions #77 through 79), the results were similar, although not as dramatic. The PAA at active levels of 0.0015 and 0.006% reduced the spore count by 77% and 99%, respectively. Without PAA in Solution #77, the reduction was 75%.

These results are notable in that they show that the spore count was reduced by a cleaning action rather than by a microbiocidial action. The cleaning time of 30 minutes is substantially less than the necessary contact time for PAA to act as a biocide.

Example 7

The data in this example looked at improving cleaning properties to facilitate the removal of soil contaminants containing secondary polyamide wet-strength resins. Press felts from Mill 'E' and Mill 'F' were used to run laboratory cleaning studies using the Nalco Dynamic Felt Cleaning Recirculator described in Example 5. The two felts were taken from paper machines making toweling grades and using polyamide wet strength agents. Table 12 lists the composition of the cleaning solutions and the test result using the felt from Mill 'E'.

TABLE 12

| SOLUTION # | CITRIC ACID (%) | SULFURIC ACID (%) | AMINE OXIDE (%) | PERACETIC ACID (%) | WEIGHT LOSS (%) | IMPROVEMENT (%) |
|---|---|---|---|---|---|---|
| 80 | 2.0 | — | 0.5 | 0 | 1.48 | — |
| 81 | 2.0 | — | 0.5 | 0.003 | 1.94 | 31.1 |
| 82 | 2.0 | — | 0.5 | 0.006 | 1.87 | 26.7 |
| 83 | — | 0.4 | 0.5 | 0 | 1.28 | — |
| 84 | — | 0.4 | 0.5 | 0.003 | 1.54 | 20.3 |
| 85 | — | 0.4 | 0.5 | 0.006 | 1.58 | 23.4 |

This evaluation compared aqueous citric and sulfuric acid cleaning solutions containing an amine oxide wetting agent and varying amounts of PAA. The gravimetric test results show that soil removal was improved by 31% with Solution #81 containing 0.003% PAA when compared to Solution #80 without PAA.

Laboratory cleaning evaluations were made using the press felt from Mill 'F'. This work was an evaluation of cleaning solutions containing glycolic acid and a 9 mole ethoxylated secondary alcohol to replace the amine oxide with varying concentrations of PAA. The results of this evaluation are shown in Table 13. The total soil load was reduced by more than 40% with Solution # 87 containing 0.003% PAA when compared to Solution #86 without PAA.

TABLE 13

| SOLUTION # | HYDROXYACETIC ACID (%) | ALCOHOL ETHOXYLATE (%) | PERACETIC ACID (%) | WEIGHT LOSS (%) | IMPROVEMENT (%) |
|---|---|---|---|---|---|
| 86 | 2.0 | 0.5 | 0 | 2.02 | — |
| 87 | 2.0 | 0.5 | 0.003 | 2.86 | 41.6 |
| 88 | 2.0 | 0.5 | 0.006 | 2.90 | 43.6 |

While the present invention is described above in connection with preferred or illustrative embodiments, these embodiments are not intended to be exhaustive or limiting of the invention. Rather, the invention is intended to cover all alternatives, modifications and equivalents included within its spirit and scope, as defined by the appended claims.

What is claimed is:

1. A method of removing and preventing the buildup of contaminants in a papermaking wet press felt and on a forming wire which comprises the step of treating the felt and wire with a cleaning solution that contains an effective amount of at least one acidic cleaning compound and peracetic acid.

2. The method of claim 1 wherein the acidic cleaning compound is an organic acid.

3. The method of claim 1 wherein the acidic cleaning compound is a mineral acid.

4. The method of claim 2 wherein the organic acid is selected from the group consisting of hydroxyacetic acid, acetic acid, citric acid, formic acid, oxalic acid and sulfamic acid.

5. The method of claim 4 wherein the organic acid is hydroxyacetic acid.

6. The method of claim 4 wherein the organic acid is citric acid.

7. The method of claim 3 wherein the mineral acid is selected from the group consisting of sulfuric acid, phosphoric acid, nitric acid and hydrochloric acid.

8. The method of claim 7 wherein the mineral acid is sulfuric acid.

9. The method of claim 7 wherein the mineral acid is phosphoric acid.

10. The method of claim 1 wherein the amount of peracetic acid in the cleaning solution is from about 0.0001 to about 1% by weight.

11. The method of claim 1 wherein the amount of peracetic acid in the cleaning solution is from about 0.001 to about 0.05% by weight.

12. The method of claim 1 wherein the amount of peracetic acid in the cleaning solution is from about 0.003 to about 0.02% by weight.

13. The method of claim 2 wherein the amount of organic acid in the cleaning solution is from about 0.2 to about 30% by weight.

14. The method of claim 2 wherein the amount of organic acid in the cleaning solution is from about 1 to about 10% by weight.

15. The method of claim 3 wherein the amount of mineral acid in the cleaning solution is from about 0.001 to about 20% by weight.

16. The method of claim 3 wherein the amount of mineral acid in the cleaning solution is from about 0.01 to about 10% by weight.

17. The method of claim 1 wherein the cleaning solution further includes at least one surfactant.

18. The method of claim 17 wherein the surfactant is selected from the group consisting of anionic, cationic, nonionic and amphoteric surfactants.

19. The method of claim 17 wherein the amount of surfactant in the cleaning solution is from about 0.001 to about 10% by weight.

20. The method of claim 17 wherein the amount of surfactant in the cleaning solution is from about 0.01 to about 1% by weight.

21. The method of claim 1 wherein the cleaning solution further includes at least one glycol ether.

22. The method of claim 21 wherein the glycol ether is selected from the group consisting of diethylene glycol ether, ethylene glycol monobutyl ether, propylene glycol monobutyl ether, diethylene glycol monoethyl ether, ethylene glycol monoethyl ether, diethylene glycol monohexyl ether, propoxy propanol, ethylene glycol monohexyl ether, diethylene glycol monomethyl ether, propylene glycol methyl ether, dipropylene glycol methyl ether and tripropylene glycol methyl ether.

23. The method of claim 21 wherein the amount of glycol ether in the cleaning solution is from about 0.1 to about 30% by weight.

* * * * *